US007914371B2

(12) United States Patent
O'Brien

(10) Patent No.: US 7,914,371 B2
(45) Date of Patent: Mar. 29, 2011

(54) INSTANT-WIN LOTTERY GAME AND TICKET

(75) Inventor: Jim O'Brien, Burlington, MA (US)

(73) Assignee: Scientific Games International, Inc., Alpharetta, GA (US)

( * ) Notice: Subject to any disclaimer, the term of this patent is extended or adjusted under 35 U.S.C. 154(b) by 818 days.

(21) Appl. No.: 11/788,514

(22) Filed: Apr. 20, 2007

(65) Prior Publication Data

US 2008/0015007 A1 Jan. 17, 2008

Related U.S. Application Data

(60) Provisional application No. 60/794,256, filed on Apr. 21, 2006.

(51) Int. Cl.
*A63F 13/00* (2006.01)

(52) U.S. Cl. ..... 463/17; 273/274

(58) Field of Classification Search ..... 463/17, 463/16, 20, 25; 273/121 B, 274, 242
See application file for complete search history.

(56) References Cited

U.S. PATENT DOCUMENTS 5,033,744 A * 7/1991 Bridgeman et al. ..... 463/13
5,947,821 A * 9/1999 Stone ..... 463/13
6,168,521 B1 * 1/2001 Luciano et al. ..... 463/18
6,877,748 B1 * 4/2005 Patroni et al. ..... 273/292
7,326,115 B2 * 2/2008 Baerlocher ..... 463/25
7,563,164 B2 * 7/2009 D'Esposito ..... 463/17
2003/0055727 A1 * 3/2003 Walker et al. ..... 705/14
2003/0119573 A1 * 6/2003 McClintic ..... 463/16
2004/0147321 A1 * 7/2004 Duhamel ..... 463/42
2004/0242308 A1 * 12/2004 Gray ..... 463/17
2006/0100008 A1 * 5/2006 Wright et al. ..... 463/17
2006/0160599 A1 * 7/2006 Tulley et al. ..... 463/16
2006/0163806 A1 * 7/2006 Toyoda ..... 273/142 R
2006/0217173 A1 * 9/2006 Walker et al. ..... 463/16
2007/0026926 A1 * 2/2007 Romanik ..... 463/17
2007/0167216 A1 * 7/2007 Walker et al. ..... 463/18
2008/0132314 A1 * 6/2008 Robb et al. ..... 463/17

* cited by examiner

*Primary Examiner* — Melba Bumgarner
*Assistant Examiner* — Masuda Hmed
(74) *Attorney, Agent, or Firm* — Dority & Manning, P.A.

(57) ABSTRACT

A method for playing an extension game to an instant lottery game is disclosed. A player purchases an instant lottery game and wins a prize for the instant lottery game. The player is provided a chance to participate in the extension game of double-or-nothing. If the player chooses to participate in the extension game of double-or-nothing, the player tenders his winning ticket to a lottery retailer. The winning ticket is scanned by a lottery terminal and a result is generated for the extension game of double-or-nothing. If the winning ticket is also a winner of the extension game, the player doubles his winning. If the winning ticket is not a winner, the player forfeits his winning from the instant lottery game.

15 Claims, 5 Drawing Sheets

INSTANT-WIN LOTTERY GAME AND TICKET

CROSS-REFERENCE TO RELATED APPLICATION

This application claims the benefit of the U.S. Provisional Patent Application No. 60/794,256, "Instant-Win Lottery Game And Ticket," filed on Apr. 21, 2006, the specification of which is incorporated in its entirety herein by this reference.

BACKGROUND OF THE INVENTION

1. Field of The Invention

The invention relates generally to instant win lottery or promotional types of games and game methods, and more specifically, to systems and methods of implementation a primary lottery game with an optional second game.

2. Description of Related Art

People like to play games of chance, whether it is poker, horse racing, or lottery games. Games of chance that entertain people enjoy greater popularity. It is in games of chance to "parlay" a first bet and raise the stake by betting "double or nothing." Double or nothing increases the entertainment value of the game when available to a series of game rounds. For a party who just won some money in an instant lottery game a simple "a double-or-nothing" has not been available.

Therefore, it is desirable to have a system and method that allows a party who plays a lottery game to play a double-or-nothing game and it is to a such lottery game the present invention is primarily directed.

SUMMARY OF THE INVENTION

In one embodiment, there is provided a method for playing a first instant lottery game with an option to play a second game upon surrender of the payout of the first lottery game if a player is a winner of the first instant lottery game. The method comprises receiving ticket information from a lottery ticket, verifying through the ticket information that the lottery ticket is a winning ticket for the first instant lottery game, if the lottery ticket is a winning ticket, verifying that the player has elected to play the second game and surrender the payout from the first instant lottery game, if the player has elected to play the second game, determining a result for the second game, determining if the lottery ticket is a winning ticket for the second game, if the lottery ticket is a winning ticket for the second game, transmitting the ticket information and the result of the second game to a remote server, and authorizing a payment of a prize for the second game.

In another embodiment, there is provided a system for playing a first instant lottery game with an option to play a second game if a player is a winner of the first instant lottery game. The system comprises a input/output controller for interfacing with external devices, a random number generator for generating a random number, and a controller. The controller is capable of receiving ticket information of a lottery ticket from input/output controller, verifying through the ticket information that the lottery ticket is a winning ticket for the first instant lottery game, if the lottery ticket is a winning ticket, verifying that the player has elected to play the second game, if the player has elected to play the second game, determining a result for the second game using the random number from the random number generator, determining if the lottery ticket is a winning ticket for the second game, if the lottery ticket is a winning ticket for the second game, transmitting the ticket information and the result of the second game to a remote server, and authorizing a payment of a prize for the second game.

Other advantages and features of the present invention will become apparent after review of the hereinafter set forth Description of the Drawings, Detailed Description of the Invention, and the Claims.

DETAILED DESCRIPTION OF THE INVENTION

Briefly described the invention is a system that provides lottery game players the chance to increase their win by wagering their win for a chance to multiply the value of the game prize. The present invention discloses a novel lottery or promotional game, a scratch-off style game card, and a method of playing a game. This invention provides a unique and exciting gambling opportunity for lottery game players who win on the game initially, in that it allows a wining player to "wager" their winnings for a chance at increased winnings.

To play the game of this invention, as desired and as lawfully permitted in the jurisdiction of sale, a lottery player will take a winning game ticket to any authorized lottery/game retailer and request the "double-or-nothing" option associated with this game be played based upon the winning ticket. As desired by the lottery or game operator, a dollar limit may be established on an amount or a dollar range of winning tickets that may be played using this game method, for example, a maximum prize value of two hundred and fifty dollars ($250). The lottery retailer will scan the ticket into a lottery terminal system to validate that it is in fact a winning ticket, regardless of amount, and then the lottery terminal and/or the lottery terminal system will randomly assign the game ticket a value, for example either a zero (0) or twice the value of the original winning ticket amount for a double-or-nothing styled game. The odds of doubling a prize are set at one in two, or at any other value desired by the lottery operator, for example triple the prize for one in three odds, or quadruple the prize for one in 4 odds, and the like. The terminal or terminal system will then send a receipt message with a ticket identification code and the outcome of the wager to the terminal for the purpose of transaction integrity.

The game ticket will be provided with a box on the reverse side (rear face) of the ticket that would need to be checked by the game player prior to cashing a wining ticket in order to verify that the player is desirous of wagering their winnings for a chance at a higher value prize. As desired, the lottery operator may require an additional fee to be paid by the game player to the retailer for this additional feature of the game.

Figure 1:
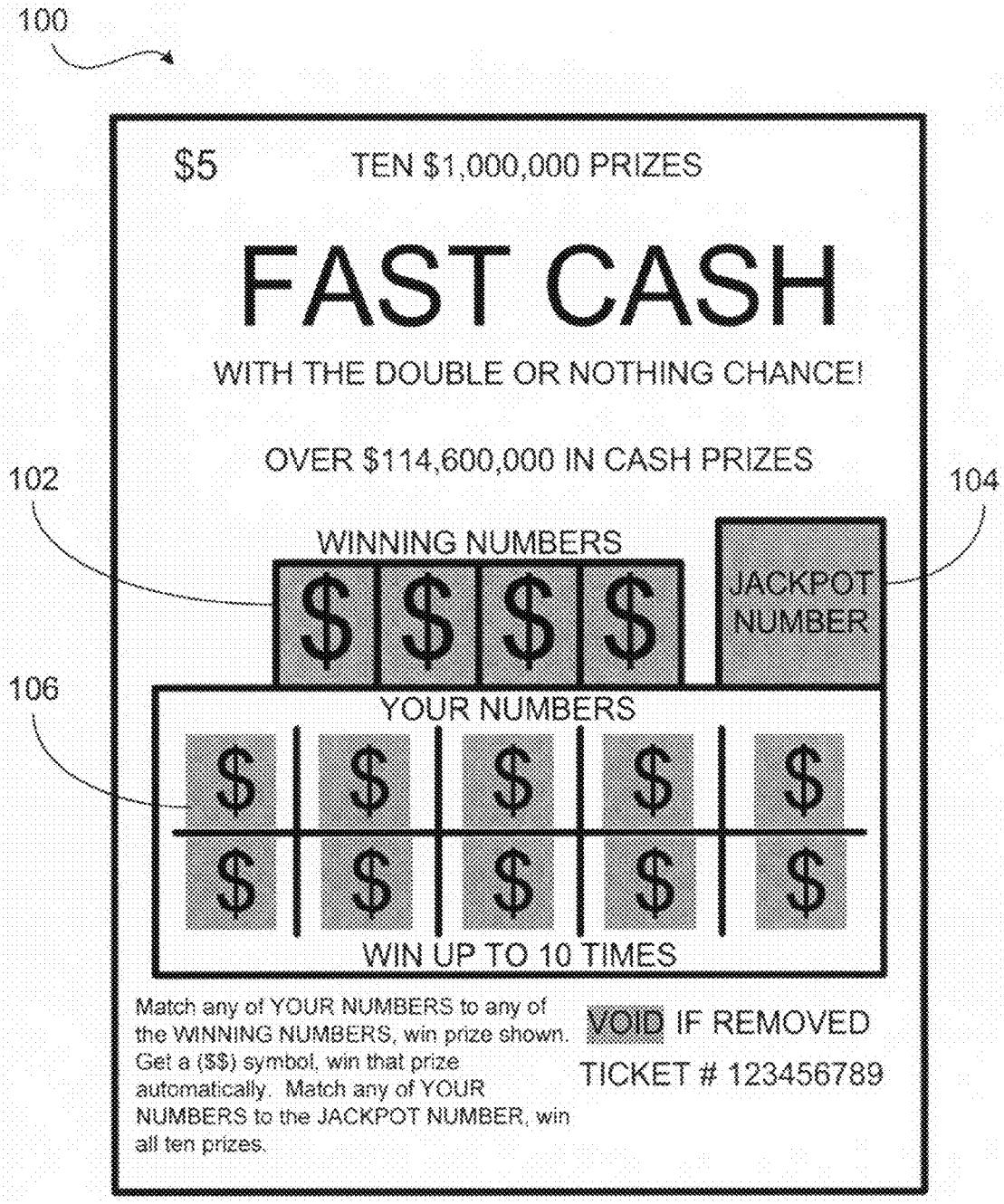
FIG. 1 illustrates a sample instant lottery ticket.
Figure 2:
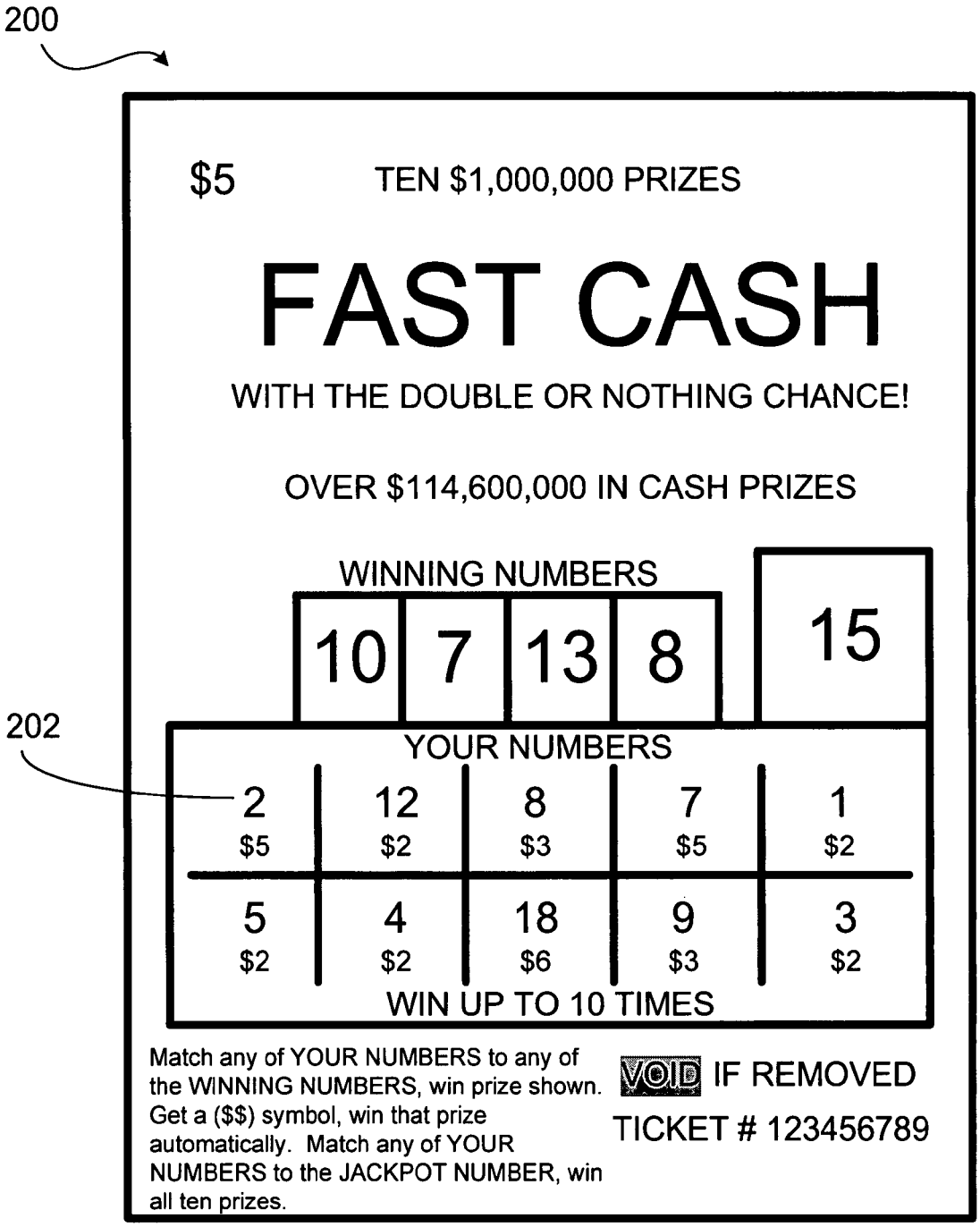
FIG. 2 illustrates a sample instant lottery ticket with game numbers revealed.

FIG. 1 is an illustration of an exemplary instant lottery game ticket 100. The instant lottery ticket 100 is printed with a plurality of pre-assigned "winning numbers" 102, a jackpot number 104, and a plurality of "your numbers" 106, which are player's numbers. The player will win a prize if any of "your numbers" 102 matches with any of "winning numbers" 106. The winning numbers 102, jackpot number 104, and your numbers 106 are initially covered with a removable material, such as latex. Those skilled in the art will appreciate that other types of instant lottery game can also be used. FIG. 2 illustrates the instant lottery game ticket 200 with the winning number, jackpot number, and your numbers revealed. Each "your number" is associated with a prize. In the embodiment shown in FIG. 2, there are two matches between the "your numbers" and "winning numbers," 7 and 8, the player would win the prizes associated with number 7, $5, and number 8, $3. The total prize for this instant lottery game ticket, is $8.

Figure 3:
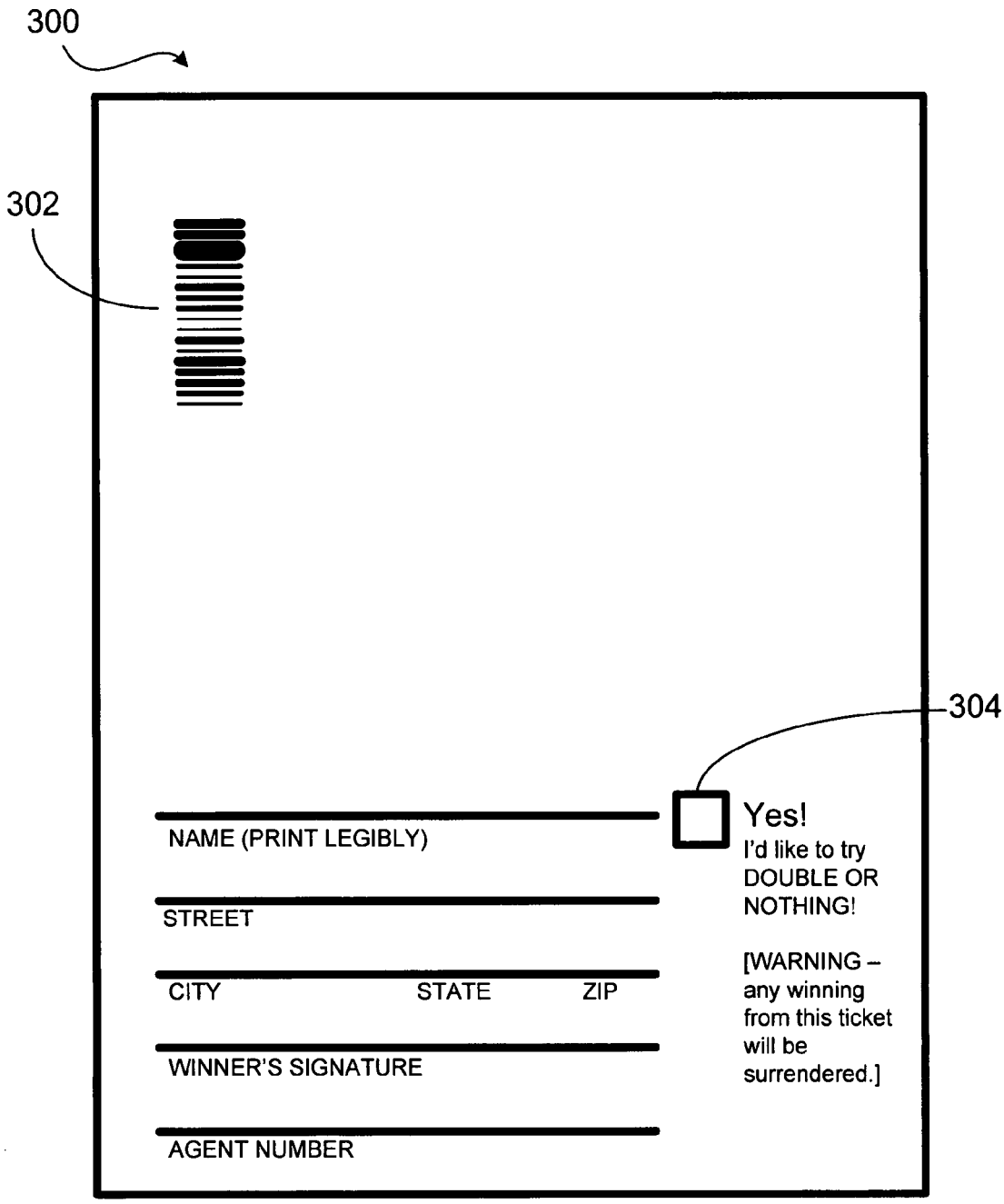
FIG. 3 illustrates the back side of a sample instant lottery ticket.

If the player decides to try double-or-nothing game, he needs to mark the backside of the instant lottery game ticket, as shown in FIG. 3, and takes the lottery game ticket to a lottery retailer. The lottery retailer will scan the winning lottery game ticket at a lottery game terminal to make sure it is a winning ticket. The lottery game terminal will also collect other pertinent information, such as lottery ticket number. After verifying the lottery ticket is a winning ticket and the player has chosen to play the double-or-nothing game and to surrender the winning from the lottery game, the lottery game terminal will generate a random number and use this random number to determine whether the player is a winner in the double-or-nothing game. If the player is a winner, the lottery game terminal will make a record, transmit the record to a central server, and authorize the payment to the player.

Figure 4:
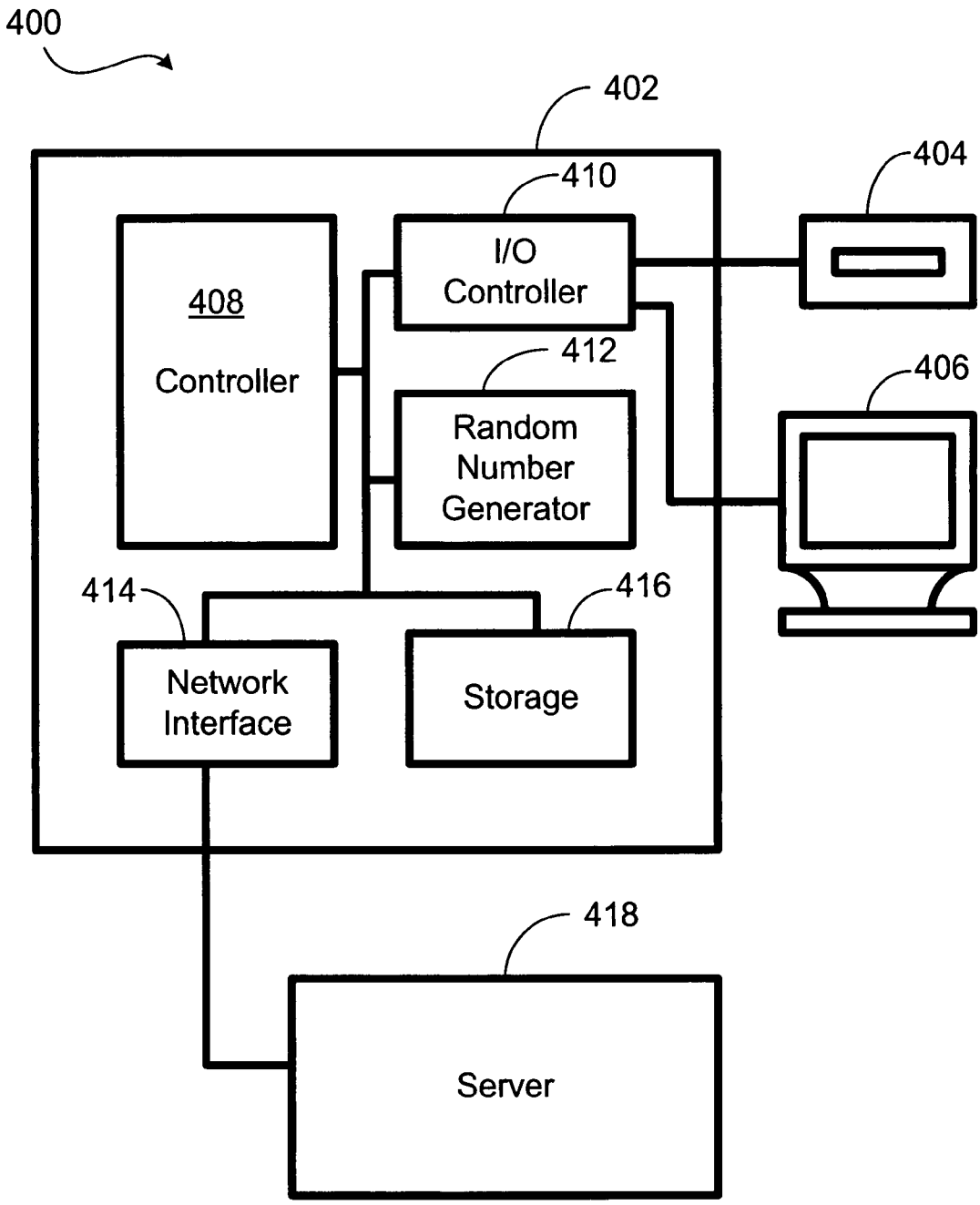
FIG. 4 illustrates architecture of a system according to one embodiment of the invention.

FIG. 4 illustrates architecture 400 of a system supporting the present invention. The system includes a lottery game terminal 402 connected through a data network to a central server 418. The lottery game terminal 402 is equipped with a lottery game ticket input device 404, such as a scanner, and an output display device 406, such as a display terminal. The lottery game terminal 402 includes an input/output (I/O) controller 410, a random number generator 412, a central controller 408, a storage unit 416, and a network interface unit 414. The I/O controller 410 is capable of interfacing with external devices, such as the scanner 404, display device 406, and a keyboard (not shown). The random number generator 412 is capable of generating a random number used for determining if a lottery ticket is a winner. The storage unit 416 is used for storing game related information; The network interface unit 414 enables the lottery game terminal 402 to communicate with a central server 418 operated by a lottery authority.

Figure 5:
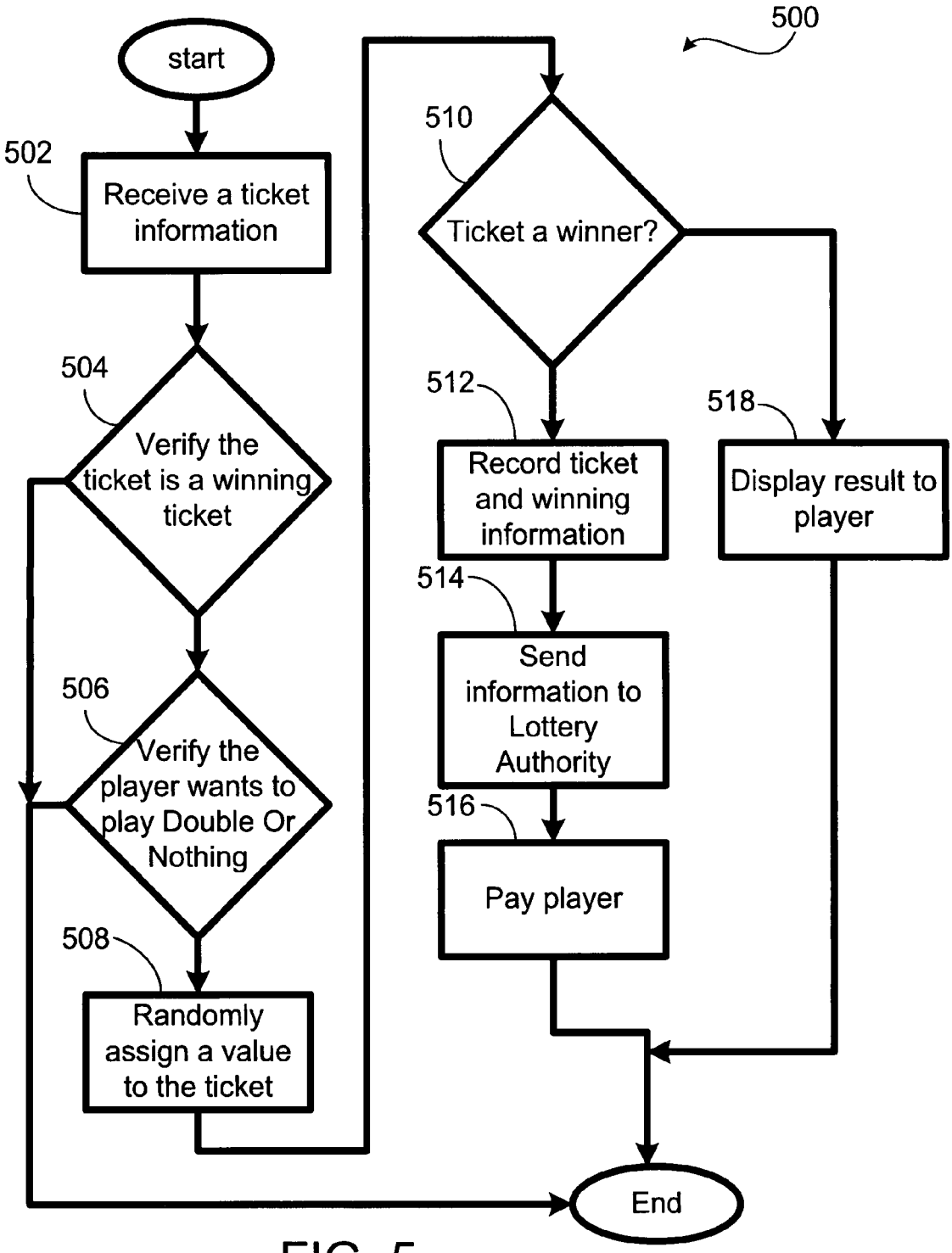
FIG. 5 is a flowchart of a system process according to one embodiment of the invention.

FIG. 5 is a flowchart 500 for a lottery game terminal process. After a player purchases an instant lottery game ticket and realizes he has won a prize, the player can take the winning lottery ticket to a lottery retailer. The lottery retailer may inquire the player if he wishes to participate in a double-or-nothing extension game. If the player is willing to participate in this extension game, the player marks the ticket as agreeing to participate in such extension and hands the lottery ticket to the lottery retailer. The information about the winning lottery ticket is scanned by a scanner or otherwise input by the lottery retailer, step 502. The lottery game terminal verifies that the lottery ticket is a winning ticket, step 504, and that the player has selected to play the double-or-nothing extension game, step 506. If the lottery ticket is not a winning ticket or if the player has not marked the lottery ticket that he wants to participate in the double-or-nothing game, the lottery game terminal rejects the lottery ticket and the process is stopped.

After verifying the lottery ticket is a winning ticket and the player's willingness to participate in the double-or-nothing game, the lottery game terminal randomly generates a number and assigns it to the ticket. The randomly generated number determines whether the lottery ticket is a winner of the double-or-nothing game. After assigning the random number, the lottery game terminal checks the random number to see if the lottery ticket is a winner. The winner may be determined according to a variety of factors. One example of such determination is whether the random number is an odd or even number. The winning criteria can be as simple as the even number yields a winner. If the random number assigned to the ticket is an even number, the player wins double of his original winning. If the original winning is $8, then the player wins $16 instead of $8. If the random number is an odd number, then the player loses $8, surrenders his winning, and wins nothing. One skilled in the art will appreciate that other means can also be used to determine the result of the double-or-nothing game.

If the lottery ticket is not a winner, the lottery game terminal displays a message and the result of the double-or-nothing game to the player, step 518. If the lottery ticket is a winner, the lottery game terminal records the ticket and winning information, step 512, sends the information to the remote server operated by the lottery authority, step 514, and authorizes the lottery retailer to pay the player, step 516.

The player who buys an instant lottery game ticket according to the present invention will have the option to participate the extension game of "double-or-nothing." The player has this option only after the instant lottery game ticket he purchased is a winning ticket for the instant lottery game. The lottery authority has the option of charging additional fee for the participation of this extension game, i.e., the lottery authority may charge an additional fee for the player to participate the double-or-nothing game. Alternatively, the lottery authority may offer this double-or-nothing game for free.

In an alternative embodiment, the lottery authority may require a player to pay an additional fee to play the "double-or-nothing" game and the lottery authority may also institute a prize for this second game that is larger than doubling the winning of a first lottery game. For example, if the initial winning for the first lottery game is $9, the lottery authority may charge additional $1 to play a "treble-or-nothing" game. If the player wins this "treble-or-nothing" game after paying $1, he will win $27 instead of $9. If he loses, he loses $9, which is the prize or payout from the first lottery game, and $1 for entering the "treble-or-nothing" game.

As shown in the drawings, the game ticket is otherwise conventionally fashioned of known composition and manufacture. The game ticket is comprised of a substrate upon which data is imaged, some of this data being predetermined and fixed in nature, for example the game name, the sponsoring entity and game play instructions, and with certain of the game data being variably imaged and securely covered by a latex or a scratch-off type of a coating, as known.

Although several preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Thus, it is understood that the invention is not limited to the specific embodiments disclosed herein, and that many modifications and other embodiments of the inventions are intended to be included within the scope of the appended claims. Moreover, although specific terms are employed herein, as well as in the claims, they are used in a generic and descriptive sense only, and not for the purposes of limiting the described invention, nor the claims which follow below.

What is claimed is:

1. A method for playing a first instant lottery game with an option to play a second game, if a player is a winner of the first instant lottery game, providing the player with a payout and by surrendering the payout of the first lottery game, comprising the steps of:

receiving ticket information at a lottery terminal system from a lottery ticket;

verifying through the lottery terminal system collecting ticket information that the lottery ticket is a winning ticket for the first instant lottery game;

if the lottery ticket is a winning ticket, the lottery terminal system verifying that the player has elected to play the second game by altering the lottery ticket in a discernable manner as indicated on the lottery ticket and surrendering the payout from the first instant lottery game;

if the player has elected to play the second game, the lottery terminal system assigning a randomly generated indicia to the lottery ticket and determining a result for the second game independent of input from the player;

determining if the lottery ticket is a winning ticket for the second game by determining if the assigned randomly generated indicia is a winning indicia;

if the lottery ticket is a winning ticket for the second game, the lottery terminal system transmitting the ticket information and the result of the second game to a remote server; and the lottery terminal system authorizing a payment of a prize for the second game.

2. The method of claim 1, further comprising the step of, if the lottery ticket is not a winning ticket for the second game, forfeiting a prize associated with the first instant lottery game.

3. The method of claim 1, further comprising the step of the lottery terminal system determining a potential secondary prize based upon a prize associated with the first instant lottery game.

4. The method of claim 3, wherein the potential secondary prize for the second game is double of the prize associated with the first instant lottery game.

5. The method of claim 1, further comprising the step of the lottery terminal system displaying a result of the second game to the player.

6. A system for playing a first instant lottery game with an option to play a second game if a player is a winner of the first instant lottery game, the system comprising:

a input/output controller for interfacing with external devices;

a random number generator for generating a random number; and a controller being capable of:

receiving ticket information of a lottery ticket from input/output controller;

verifying through the ticket information that the lottery ticket is a winning ticket for the first instant lottery game;

if the lottery ticket is a winning ticket, providing the player with a payout;

verifying that the player has elected to play the second game by altering the lottery ticket in a discernable manner as indicated on the lottery ticket and surrendering the payout from the first instant lottery game;

if the player has elected to play the second game, the controller determining a result for the second game using the random number from the random number generator to generate a random number and assign it to the lottery ticket independent of input from the player;

determining if the lottery ticket is a winning ticket for the second game by determining if the assigned random number is a winning number;

if the lottery ticket is a winning ticket for the second game, transmitting the ticket information and the result of the second game to a remote server; and authorizing a payment of a prize for the second game.

7. The system of claim 6, wherein the prize for the second game is double of a prize associated with the first instant lottery game.

8. The system of claim 6, wherein the controller further being capable of, if the lottery ticket is not a winning ticket for the second game, forfeiting a prize associated with the first instant lottery game.

9. The system of claim 6 further comprising a scanner in communication with the input/output controller.

10. The system of claim 6 further comprising a display terminal in communication with the input/output controller.

11. A non-transitory computer-readable medium on which is stored a computer program for playing an first instant lottery game with an option to play a second game if a player is a winner of the first instant lottery game, the computer program comprising computer instructions that when executed by a computer performs the steps of:

receiving ticket information from a lottery ticket;

verifying through the ticket information that the lottery ticket is a winning ticket for the first instant lottery game;

if the lottery ticket is a winning ticket, providing the player with a payout;

verifying that the player has elected to play the second game and surrender the payout from the first instant lottery game by altering the lottery ticket in a discernable manner as indicated on the lottery ticket;

if the player has elected to play the second game, the computer program assigning a randomly generated indicia to the lottery ticket and determining a result for the second game independent of input from the player;

determining if the lottery ticket is a winning ticket for the second game by determining if the assigned randomly generated indicia is a winning indicia;

if the lottery ticket is a winning ticket for the second game, transmitting the ticket information and the result of the second game to a remote server; and authorizing a payment of a prize for the second game.

12. The computer program of claim 11, further performs the step of, if the lottery ticket is not a winning ticket for the second game, forfeiting a prize associated with the first instant lottery game.

13. The computer program of claim 11, further performs the step of determining a potential secondary prize based upon a prize of the first instant lottery game.

14. The computer program of claim 13, wherein the potential secondary prize for the second game is double of the prize associated with the first instant lottery game.

15. The computer program of claim 11, further performs the step of displaying a result of the second game to the player.

* * * * *